US008175502B2

(12) United States Patent
Itagaki et al.

(10) Patent No.: US 8,175,502 B2
(45) Date of Patent: May 8, 2012

(54) DEVELOPING DEVICE, IMAGE FORMING APPARATUS AND DEVELOPING ROLLER

(75) Inventors: Seiko Itagaki, Tokyo (JP); Hiroshi Akita, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 397 days.

(21) Appl. No.: 12/466,182

(22) Filed: May 14, 2009

(65) Prior Publication Data

US 2009/0290913 A1 Nov. 26, 2009

(30) Foreign Application Priority Data

May 20, 2008 (JP) ..... 2008-131696

(51) Int. Cl.
*G03G 15/09* (2006.01)

(52) U.S. Cl. ..... 399/277

(58) Field of Classification Search ..... 399/265, 399/267, 277
See application file for complete search history.

(56) References Cited

U.S. PATENT DOCUMENTS 5,978,634 A * 11/1999 Sato et al. ..... 399/277
6,421,520 B2 * 7/2002 Masuda et al. ..... 399/277
6,473,586 B2 * 10/2002 Noda et al. ..... 399/267 X
6,704,534 B2 * 3/2004 Hibino ..... 399/277
6,879,800 B2 * 4/2005 Mabuchi et al. ..... 399/277 X
7,027,761 B2 * 4/2006 Koetsuka et al. ..... 399/277
2006/0228135 A1 * 10/2006 Miyoshi ..... 399/277
2008/0080906 A1 * 4/2008 Kawahara et al. ..... 399/277

FOREIGN PATENT DOCUMENTS

JP 11-161029 A 6/1999
JP 2000-56569 A 2/2000
JP 2004-327871 A 11/2004
JP 2008-70421 A 3/2008

OTHER PUBLICATIONS

Japanese Office Action for Patent Application No. JP2008-131696 drafted Feb. 18, 2010 with English translation.

* cited by examiner

*Primary Examiner* — Sandra Brase
(74) *Attorney, Agent, or Firm* — Cantor Colburn LLP

(57) ABSTRACT

Described is a developing roller, which makes it possible to appropriately peel developer off the developing roller, even if the developing roller is a small-sized. The developing roller includes a non-magnetic developing sleeve and a magnetic member installed into an inner space of the developing sleeve and having plural magnetic poles including a peeling magnetic pole. When a reference position is defined as such a position that exhibits a maximum value of magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7°$$

where numeral Z indicates an angle of the developing roller in the magnetic-flux density flat region.

6 Claims, 5 Drawing Sheets

DEVELOPING DEVICE, IMAGE FORMING APPARATUS AND DEVELOPING ROLLER

This application is based on Japanese Patent Application NO. 2008-131696 filed on May 20, 2008, with Japan Patent Office, the entire content of which is hereby incorporated by reference.

BACKGROUND OF THE INVENTION

The present invention relates to a developing device provided with a developing roller that bears developer including magnetic carrier and toner on its circumferential surface, so as to develop a latent image formed on an image bearing member, an image forming apparatus that is provided with the developing device, and the developing roller that bears the developer including magnetic carrier and toner on its circumferential surface, so as to develop the latent image formed on the image bearing member.

In an image forming process of the electro-photographic method, which employs two component developing agent (hereinafter, also referred to as developer) including magnetic carrier and toner, a latent image formed on a photoreceptor drum (image bearing member) is developed by applying toner included in the developer bone by the developing roller, so as to form a visible toner image on the photoreceptor drum concerned.

Generally speaking, the developing roller is constituted by a developing sleeve made of a non-magnetic material and a magnetic member provided with a plurality of fixed magnetic poles, to convey the developer to a developing magnetic pole disposed opposite to the photoreceptor drum so as to make the toner adhere onto the photoreceptor drum from the developing magnetic pole serving as one of the plurality of fixed magnetic poles. Further, the developer passed through the developing magnetic pole are peeled off the developing sleeve by the peeling action of a peeling magnetic pole, serving as another one of the plurality of fixed magnetic poles, and, after being sufficiently agitated, the developer are made to adhere onto the circumferential surface of the developing sleeve by an adhering action of a developer-layer forming magnetic pole, serving as still another one of the plurality of fixed magnetic poles.

Incidentally, the size minimization trend in the field of image forming apparatus that employs the electro-photographic process, including a copier, a printer, etc., has been considerably progressed in the recent years. Due to an influence of such the size minimization trend, the developing device that includes the developing roller has been minimized as smaller as possible. The problem to be arisen associating with the size minimization of the developing roller is a releasability of developer. The smaller the outer diameter of the developing roller is, the shorter the distance between the peeling magnetic pole and the developer-layer forming magnetic pole becomes. As a result, it becomes impossible to peel a sufficient amount of developer off the peeling magnetic pole, and accordingly, a residual amount of developer is attracted to the developing roller as it is. Therefore, it is impossible to supply the developer including a sufficient amount of toner to the developing magnetic pole, resulting in the density deterioration of the toner image to be formed on the photoreceptor drum.

To cope with the abovementioned problems, there has been set forth such a technology that adjusts the density of magnetic flux generated by the plurality of fixed magnetic poles provided in the magnetic member, so as to prevent the toner image from generating density deterioration.

For instance, according to the technology set forth in Tokkaihei 11-161029 (Japanese Non-Examined Patent Publication), the magnetic poles arranged on the circumferential surface of the developing roller from the conveyance magnetic pole (equivalent to the peeling magnetic pole) to the adhering magnetic pole (equivalent to the developer-layer forming magnetic pole) are set at the same polarity. Further, the magnetic flux density A at such a position that is rotated at 10° from the position of the adhering magnetic pole side 100G of the conveyance magnetic pole, provided on the circumferential surface of the developing roller, in the reverse direction of the developing roller rotational direction is made to fulfill the Equation of $(A-100)/10 \leqq 16$, and the magnetic flux density B at such a position that is rotated at 10° from the position of the conveyance magnetic pole side 100G of the adhering magnetic pole, provided on the circumferential surface of the developing roller, in the developing roller rotational direction is made to fulfill the Equation of $(B-100)/10 \leqq 15$. In other words, Tokkaihei 11-161029 sets forth such the technology that, considering the releasability of developer, the magnetic flux density around the peripheral space of the specific fixed magnetic pole is adjusted to a predetermined value.

According to the technology set forth in the Tokkaihei 11-161029, however, merely the magnetic flux density around the peripheral space of the conveyance magnetic pole (equivalent to the peeling magnetic pole) and/or around the peripheral space of the adhering magnetic pole (equivalent to the developer-layer forming magnetic pole) is adjusted, and the magnetic flux density at the conveyance magnetic pole becomes high. As a result, since the attractive force toward the center of the developing roller at the conveyance magnetic pole is getting large, the developer residing at that portion are attracted toward the developing roller, resulting in insufficient releasability of the developer.

SUMMARY OF THE INVENTION

To overcome the abovementioned drawbacks in conventional developing device, it is one of objects of the present invention to provide a developing roller and a developing device, which makes it possible to appropriately peel developer off the developing roller, even if the developing roller is a small-sized developing roller.

Accordingly, at least one of the objects of the present invention can be attained by any one of the developing devices, the image forming apparatuses and the developing rollers described as follows.

(1) According to a developing device reflecting an aspect of the present invention, the developing device comprises: a developing roller to bear developer, including magnetic carriers and toner, on a circumferential surface thereof, so as to develop a latent image formed on an image bearing member; and a developer supplying section to supply the developer onto the developing roller; wherein the developing roller is provided with: a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7°$$

where numeral Z indicates an angle of the developing roller in the magnetic-flux density flat region.

(2) According to another aspect of the present invention, in the developing device recited in item 1, the magnetic flux density within the magnetic-flux density flat region is equal to or greater than 98% of the maximum value.

(3) According to an image forming apparatus reflecting still another aspect of the present invention, the image forming apparatus comprises: an image bearing member to form a latent image on a circumferential surface thereof; a developing device that includes a developing roller to bear developer, including magnetic carriers and toner, on a circumferential surface thereof, so as to develop the latent image formed on the image bearing member; a transferring section to transfer a toner image formed on the image bearing member; and a fixing section to fix the toner image onto a sheet; wherein the developing roller is provided with: a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7°$$

where numeral Z indicates an angle of the developing roller in the magnetic-flux density flat region.

(4) According to still another aspect of the present invention, in the image forming apparatus recited in item 3, the magnetic flux density within the magnetic-flux density flat region is equal to or greater than 98% of the maximum value.

(5) According to a developing roller reflecting still another aspect of the present invention, the developing roller that bears developer, including magnetic carriers and toner, on a circumferential surface thereof, so as to develop a latent image formed on an image bearing member, comprises: a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7°$$

where numeral Z indicates an angle of the developing roller in the magnetic-flux density flat region.

(6) According to yet another aspect of the present invention, in the developing roller recited in item 5, the magnetic flux density within the magnetic-flux density flat region is equal to or greater than 98% of the maximum value.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

<Rough Configuration of Image Forming Apparatus>

Figure 1:
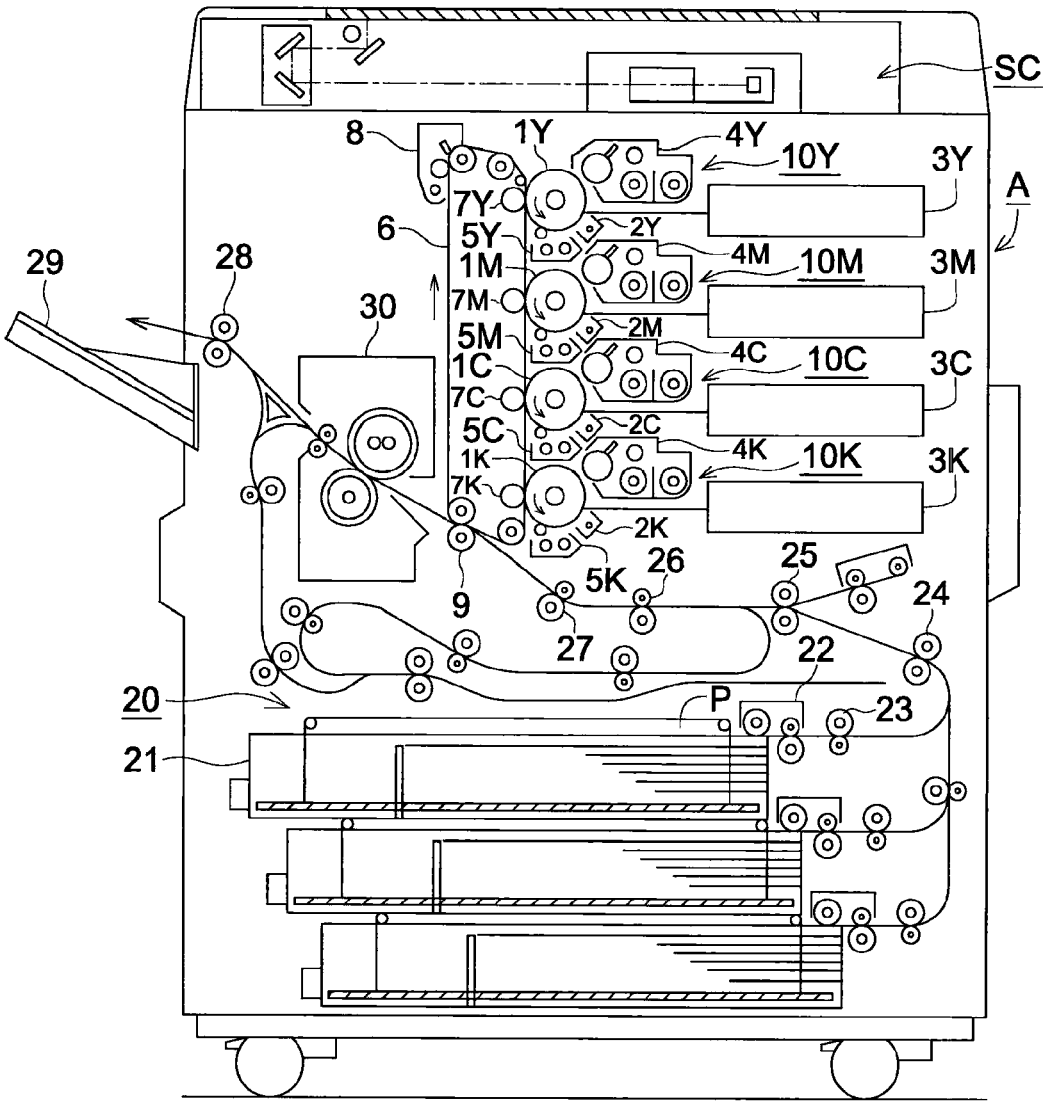
FIG. 1 shows a center cross sectional schematic diagram indicating an internal configuration of an image forming apparatus embodied in the present invention.

FIG. 1 shows a center cross sectional schematic diagram indicating an internal configuration of an image forming apparatus A. The image forming apparatus A, shown in FIG. 1, is called a tandem color image forming apparatus, and is constituted by a plurality of image forming sections 10Y, 10M, 10C, 10K, a belt-type intermediate transfer member 6, a paper sheet feeding device 20 and a fixing device 30.

On the upper section of the image forming apparatus A, an image reading device SC is mounted, so that an image residing on a document put on a platen cover (document plate) is read into a line image sensor by exposure-scanning actions performed by an optical system of an document image exposure-scanning section incorporated in the image reading device SC. Analogue signals acquired by photo-electric converting actions performed by the line image sensor are inputted into an image processing section so as to apply various kinds of image processing, such as an analogue processing, an analogue-to-digital conversion processing, a shading correction processing, an image compression processing, etc., to the analogue signals therein. Then, the processed digital image data are inputted into exposure sections 3Y, 3M, 3C, 3K. Incidentally, the line image sensor, the platen cover, the optical system of the document image exposure-scanning section and the image processing section are not clearly shown in the drawings.

The image forming section 10Y, which forms an image of unicolor Y (Yellow), includes a charging electrode 2Y, the exposure section 3Y, a developing device 4Y and a cleaning section 5Y, which are respectively disposed in the peripheral space of an image bearing member 1Y. Further, the image forming section 10M, which forms an image of unicolor M (Magenta), includes a charging electrode 2M, the exposure section 3M, a developing device 4M and a cleaning section 5M, which are respectively disposed in the peripheral space of an image bearing member 1M. Still further, the image forming section 10C, which forms an image of unicolor C (Cyan), includes a charging electrode 2C, the exposure section 3C, a developing device 4C and a cleaning section 5C, which are respectively disposed in the peripheral space of an image bearing member 1C. Yet further, the image forming section 10K, which forms an image of unicolor K (Black), includes a charging electrode 2K, the exposure section 3K, a developing device 4K and a cleaning section 5K, which are respectively disposed in the peripheral space of an image bearing member 1K.

Each of the developing devices 4Y, 4M, 4C, 4K accommodates two component developer including fine particle toner whose color is the corresponding one of unicolor Y (Yellow), unicolor M (Magenta), unicolor C (Cyan), and unicolor K (Black), and carriers.

The belt-type intermediate transfer member 6 is threaded on a plurality of rollers so as to rotatably support it. Further, the unicolor toner images Y, M, C, K formed on the image bearing members 1Y, 1M, 1C, 1K of the image forming sections 10Y, 10M, 10C, 10K are sequentially transferred onto the belt-type intermediate transfer member 6 one by one by the transferring actions performed by transferring sections 7Y, 7M, 7C, 7K, so as to form a full color toner image by superimposing the unicolor toner images Y, M, C, K.

One of paper sheets P accommodated in a paper sheet feeding cassette 21 of the paper sheet feeding device 20 is picked up by the paper sheet feeding section 22 and conveyed to a secondary transferring section 9 through pairs of paper sheet feeding rollers 23, 24, 25, 26, and a pair of registration roller 27, so that the full color toner image formed on the belt-type intermediate transfer member 6 is transferred onto corresponding one of paper sheets P. In this connection, configurations of paper sheet feeding cassettes 21, which are arranged substantially in a vertical direction at the lower space of the image forming apparatus A so as to configure them as a three stage structure, are substantially the same. Further, configurations of paper sheet feeding sections 22, which are respectively incorporated into the three stages of the paper sheet feeding cassettes 21, are substantially the same, as well. Hereinafter, the paper sheet feeding cassette 21 including the paper sheet feeding section 22 is called the paper sheet feeding device 20. Successively, the paper sheet P, on which the full color toner image is transferred, is further conveyed into the fixing device 30 (fixing section), in which the paper sheet P is tightly clipped by a pair of fixing rollers so as to apply heat and pressure onto both the paper sheet P and the full color toner image, to fix the full color toner image onto the paper sheet P. Still successively, the paper sheet P, on which the full color toner image is fixed, is tightly clipped by a pair of ejecting rollers 28 so as to ejects it onto an ejecting tray 29 disposed outside the apparatus.

On the other hand, after the full color toner image has been transferred onto the paper sheet P from the belt-type intermediate transfer member 6 and the paper sheet P has been separated from the belt-type intermediate transfer member 6 by employing the curvature separating action, the residual toner remaining on the belt-type intermediate transfer member 6 are removed by the cleaning action performed by a belt cleaning section 8.

In this connection, although the color image forming operation has been exemplified for describing the image forming apparatus A in the foregoing, it is needless to say that the monochrome image forming operation is also included within the scope of the present invention. Hereinafter, each of the developing devices 4Y, 4M, 4C, 4K is also referred to as a developing device 4 as its general term, and further, each of the image bearing member 1Y, 4M, 4C, 4K is also referred to as a image bearing member 1 as well as the above. Further, hereinafter for simplicity, the above terminological rule will be also applied to the other terms included in the four color image forming sections.

<Rough Configuration of Developing Device>

Figure 2:
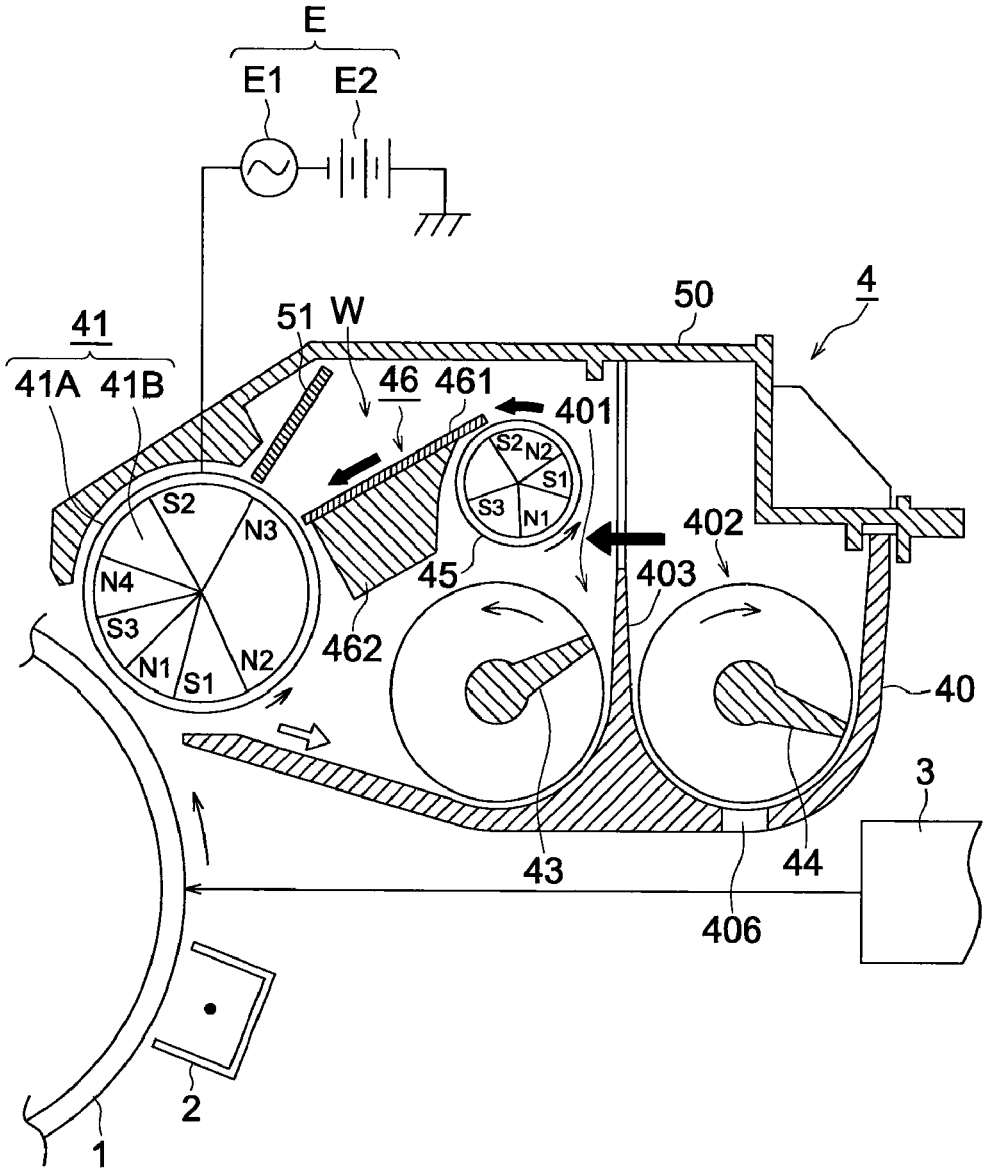
FIG. 2 shows a cross sectional schematic diagram indicating a rough configuration of a developing device embodied in the present invention.

FIG. 2 shows a cross sectional schematic diagram indicating a rough configuration of the developing device 4 embodied in the present invention. A housing body of the developing device 4 is constituted by a lower casing 40, covering the lower space, and an upper casing 50, covering the upper space, in such a manner that the upper casing 50 can be opened and closed relative to the lower casing 40. Further, the developing device 4 is constituted by a developing roller 41, a guide member 46, a toner supplying roller 45, a first agitating member 43, a second agitating member 44, etc. Still further, the guide member 46 is constituted by a guiding plate 461 and a pedestal section 462.

Each of the developing devices 4Y, 4M, 4C, 4K accommodates the two component developing agent including the fine particle toner whose color is the corresponding one of unicolor Y (Yellow), unicolor M (Magenta), unicolor C (Cyan), and unicolor K (Black), which are unicolors being different from each other, and the carriers. Concretely speaking, the two component developing agent includes the carriers, each particle of which is a ferrite core coated with an insulating resin material, and the toner that includes polyester as its main gradients and various kinds of additives including a coloring agent such as a pigment, a carbon black, etc., a charge controlling agent, a silica, a titanium oxide, etc.

The particle diameter and the saturation magnetization of the carriers are set at a value in a range of 10-50 μm and another value in a range of 10-80 emu/g, respectively. On the other hand, the particle diameter of the toner is set at a value in a range of 4-10 μm, while the charging characteristic of the toner is a negative charging characteristic and the average charge amount is set at a value in a range of −20--60 μC/g. Further, the present embodiment employs such the two component developing agent that includes the above-specified carriers and toner, which are mixed with each other so as to set the toner density at a value in a range of 4-10%/mass (percentage by mass).

As shown in FIG. 2, the developing roller 41, the first agitating member 43, the second agitating member 44, the toner supplying roller 45, the guide member 46, etc., are arranged in the lower space of the developing device 4, enclosed by the lower casing 40. Further, the toner supplying roller 45, the first agitating member 43 and the second agitating member 44 are driven by an agitating motor (not shown in the drawings), serving as a common driving source of them. The first agitating member 43 and the second agitating member 44 are rotated at a rotational velocity in a range of 250-700 rpm.

The lower casing 40 creates a developer supplying chamber 401 that accommodates the first agitating member 43 and a developer agitating chamber 402 that accommodates the second agitating member 44. Concretely speaking, a partition wall 403 protruded from the bottom section of the lower casing 40 forms both the developer supplying chamber 401 and the developer agitating chamber 402, which are separated from each other while putting the partition wall 403 between them.

Further, a toner density sensor 406 is disposed at such a position that is located downstream the conveying direction of the developer and just below the second agitating member 44 on the bottom surface of the lower casing 40. The toner density sensor 406, complying with the magnetic permeability detecting method, detects a property based on the magnetic permeability of the developer (carriers) serving as a material under test, and outputs the detected property as, for instance, a voltage value. Compared to the reference toner density, the higher the toner density detected by the toner density sensor 406 is, the lower the output value becomes, while, the lower the toner density detected by the toner density sensor 406 is, the higher the output value becomes. As abovementioned, it is possible to find the toner density from the output value of the toner density sensor that complies with the magnetic permeability detecting method. Then, corresponding to the toner density detected, a suitable amount of toner is supplied from a toner supplying section (not shown in the drawings) so as to keep the toner density at a predetermined value.

Still further, the developing roller 41 is constituted by a developing sleeve 41A that is rotatable, a magnet roller (magnet member) 41B that is fixed and generates magnetic fields.

At the opposing near point between the developing sleeve 41A and the magnet roller 41B, the developing sleeve 41A rotates upward from the bottom space to the upper space, while, the first agitating member 43 rotates downward from the upper space to the bottom space.

Still further, a developer amount regulating member 51 is fixed at the ceiling section located inside the upper casing 50. Accordingly, a wide space, serving as a developer flow rectifying space W, is created between the guiding plate 461 and the inner wall surface of the upper casing 50, so as to make it possible to accommodate a large amount of developer therein.

The developing roller 41 is disposed at such a position that opposes to the image bearing member 1 and is rotated by a driving motor (not shown in the drawings) through a coupling gear (not shown in the drawings). Further, a developing bias voltage E, created by superimposing an alternate voltage Vac supplied from an alternate electric power source E1 and a direct-current voltage Vdc supplied from a direct-current electric power source E2 with each other, is applied to the developing sleeve 41A. For instance, as the practical operating conditions, the rotating velocity of the developing roller 41 is set at a value in a range of 200-1000 mm/sec as a line velocity of its circumferential surface, and the developing bias voltage E is set at such a value that is specified by the alternate voltage Vac in a range of 0.5-2.0 kvp-p, a frequency of the alternate voltage Vac in a range of 2-7 kHz, and the direct-current voltage Vdc in a range of −200--700 Volts, as its output voltage.

The magnet roller 41B is disposed inside the developing sleeve 41A, and provided with seven magnetic poles N1, N2, N3, N4, S1, S2, S3. Concretely speaking, the magnetic pole N1 serves as a developing magnetic pole, the magnetic pole N2 serves as a peeling magnetic pole and the magnetic pole N3 serves as a developer-layer forming magnetic pole. Further, the developer amount regulating member 51 is disposed at a position in the vicinity of the magnetic pole N3 of the magnet roller 41B.

In the present embodiment, the guide member 46 is in charge of performing a lift pumping function for supplying the developer to the developing sleeve 41A without providing a conventional lift pumping magnetic pole. Accordingly, since the lift pumping magnetic pole is excluded from the developing device 4, it becomes possible to reduce the rotational torque to be incurred to the developing sleeve 41A. In other words, it becomes possible to reduce the mechanical stresses to be generated associated with the operations for conveying and agitating the developer around the developing roller 41, and as a result, it becomes possible to improve the durability of the developer and/or the aging stability of the image quality.

Further, the magnetic poles N2, N3, which are disposed at positions being adjacent to each other among the plural magnetic poles, have the same polarity so as to form a repulsive magnetic field. The magnetic pole N2 serves as the peeling magnetic pole for peeling the developer off the developing sleeve 41A. Further, the developer supplied by the first agitating member 43 is conveyed by sliding the developer on the upper surface of the guiding plate 461, so that the magnetic pole N3, serving as the developer-layer forming magnetic pole, attracts the developer, so as to adhere the developer onto the circumferential surface of the developing sleeve 41A.

Still further, the first agitating member 43 agitates and conveys the developer conveyed from the second agitating member 44, so as to uniformly supply the developer onto the developing roller 41. Each of the first agitating member 43 and the second agitating member 44 is a screw member formed in a spiral shape. The first agitating member 43 and the second agitating member 44 are arranged in parallel to each other, and, mix and agitate flesh developer, supplied from the toner supplying section (not shown in the drawings), with the developer refluxed (recycled) from the developing sleeve 41A, so as to convey the mixed developer to the upstream space of the first agitating member 43.

The first agitating member 43 conveys the developer in an axial direction of its rotation, and at the same time, emits the developer in a direction orthogonal to the rotational axis so as to agitate the developer.

Yet further, the guide member 46 that not only separates the developer, which are peeled off the developing sleeve 41A and conveyed through the lower space in the direction indicated by the outlined arrow shown in FIG. 2, from the other developer, which are about to supply onto the developing sleeve 41A and conveyed through the upper space, but also accumulates the developer currently supplied from the toner supplying roller 45, thereon, to guide the accumulated developer towards the developing roller 41, is disposed in the vicinity of the opposing near position between the developing sleeve 41A and the first agitating member 43.

<Releasability of Developer>

Figure 3:
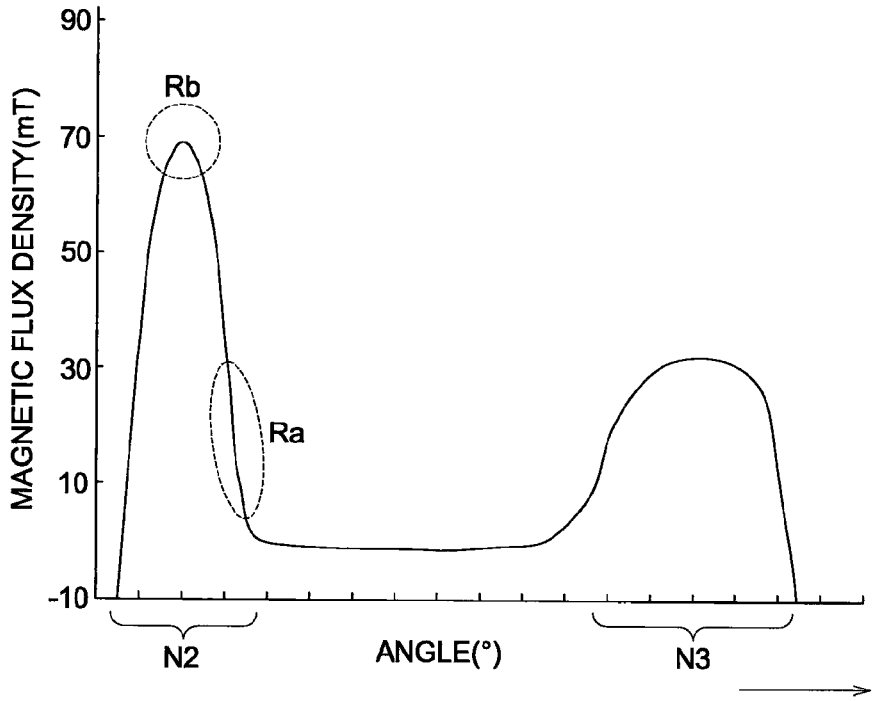
FIG. 3 shows an explanatory graph indicating a transition of a magnetic flux density on a developing roller from a peeling magnetic pole to a developer-layer forming magnetic pole, embodied in the present invention.

Next, based on the magnetic flux density of the magnetic field to be generated by each of the peeling magnetic pole N2 and the developer-layer forming magnetic pole N3, the releasability of the developer residing on the developing roller 41 will be detailed in the following. FIG. 3 shows an explanatory graph indicating a transition of the magnetic flux density on the developing roller 41 from the peeling magnetic pole N2 to the developer-layer forming magnetic pole N3. In the graph shown in FIG. 3, the horizontal axis represents an angle of current position on the developing roller 41 from the peeling magnetic pole N2 (in FIG. 3, the right direction of the horizontal axis coincides with the rotational direction of the developing sleeve 41A), while the vertical axis represents a magnetic flux density in a normal direction of the developing roller 41.

Since a value of the magnetic flux density is kept low at an angle in an intermediate range between the peeling magnetic pole N2 and the developer-layer forming magnetic pole N3 as shown in FIG. 3, a centripetal force exerted towards the center of the developing roller 41 (hereinafter, referred to as a centripetal force Fr) is small. Accordingly, the developer residing on the intermediate area between the peeling magnetic pole N2 and the developer-layer forming magnetic pole N3 can be peeled off the developing sleeve 41A. However, if a tangential force exerted towards the peeling magnetic pole N2 in the circumferential direction within the intermediate region between the peeling magnetic pole N2 and the developer-layer forming magnetic pole N3 (hereinafter, referred to as a tangential force Fθ) is small, the developer, peeled off the developing roller 41, are attracted and attached by/to the developer-layer forming magnetic pole N3 from the residential space. As a result, the density deterioration of the toner image would occur, due to the inability for supplying developer including sufficient amount of toner to the developer-layer forming magnetic pole N3 and/or the developing magnetic pole N1. Specifically, with respect to such the developing roller 41 that is provided with the developing sleeve 41A whose outer diameter is set at a value being equal to or smaller than 30 mm (also equivalent to the outer diameter of the developing roller 41), since the distance between the peeling magnetic pole N2 and the developer-layer forming magnetic pole N3 is relatively short, the developer passed through the peeling magnetic pole N2 is liable to adhere the developer-layer forming magnetic pole N3.

To overcome the abovementioned drawback, in the present embodiment, the magnetic flux density at the peeling magnetic pole N2 is made to be high as shown in FIG. 3, and the magnetic flux density in a region Ra of the peeling magnetic pole N2 is made to be high, to direct the tangential force Fθ towards the peeling magnetic pole N2 so as to attract the developer to the peeling magnetic pole N2. However, when the magnetic flux density in a region Rb, which includes the maximum value of the magnetic flux density to be generated by the peeling magnetic pole N2, is kept at the high level as shown in FIG. 3, the centripetal force Fr generated by the peeling magnetic pole N2 is getting strong, and as a result, it becomes difficult to peel the developer off the developing roller 41 (the developer hardly release from the circumferential surface of the developing sleeve 41A).

Figure 4:
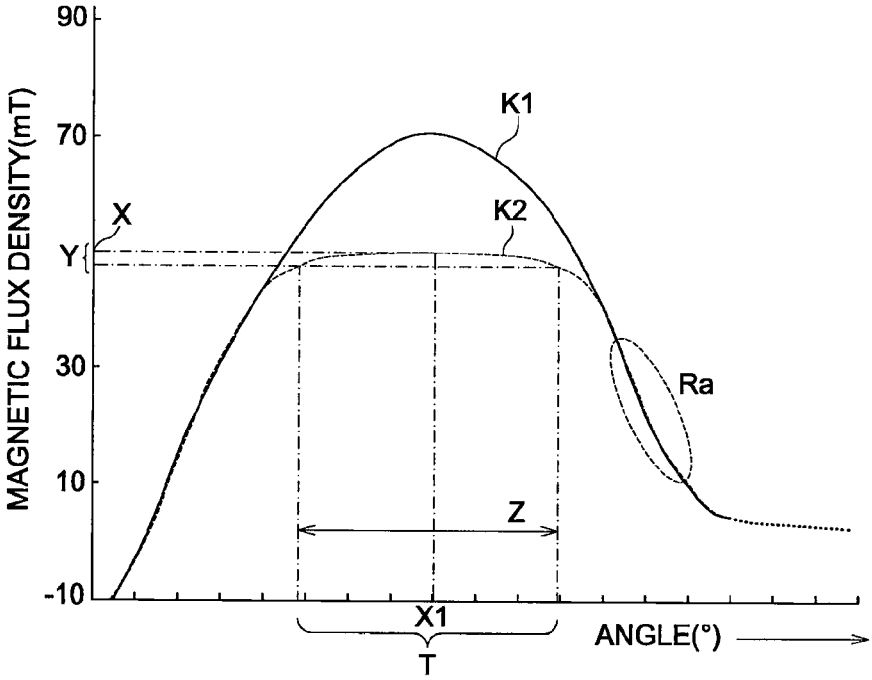
FIG. 4 shows an explanatory graph indicating a transition of a magnetic flux density in a peripheral area of a peeling magnetic pole, embodied in the present invention.

FIG. 4 shows an explanatory graph indicating a transition of the magnetic flux density in the peripheral area of the peeling magnetic pole N2. When the maximum value of the magnetic flux density to be generated by the peeling magnetic pole N2 is relatively high as indicated by a solid line K1 shown in FIG. 4, the releasability of the developer is getting worse. Accordingly, by lowering a maximum value X of the magnetic flux density to be generated by the peeling magnetic pole N2, a flat region T in which the magnetic flux density is substantially the same as the maximum value X (the flat region T includes a position X1, serving as a reference position at which the magnetic flux density is maximum) is created, so as to weaken the centripetal force Fr. It is preferable that, by making the magnetic flux density abruptly reduce in the region from the peeling magnetic pole N2 to the developer-layer forming magnetic pole N3 (region Ra shown in FIG. 4), the region in which the magnetic flux density is low is formed between the peeling magnetic pole N2 and the developer-layer forming magnetic pole N3, so as to make the tangential force Fθ directed towards the peeling magnetic pole N2 strong (greater).

The present inventor has verified the width of the flat region T that causes no problem of the density deterioration of the image and is shown in FIG. 4, through the experiments. In this connection, hereinafter, the flat region T is defined as such a region that fulfills the following Equation.

$$X \geqq Y \geqq 0.98 \times (X)$$

As the conditions for the experiments, with respect to the outer diameter of the developing roller 41, the alternate voltage Vac to be generated by the alternate electric power source E1, the direct-current voltage Vdc to be generated by the direct-current electric power source E2 and a charged voltage Vo of the image bearing member, the three combinations of the those values are established as shown in Table 1 indicated as follow.

TABLE 1

| | Experi. 1 | Experi. 1 | Experi. 1 |
|---|---|---|---|
| Outer diameter of developing roller [mm] | 25 | 25 | 30 |
| Vac [kV] | 1.0 | 0.9 | 1.0 |
| Vdc [V] | −450 | −510 | −450 |
| Vo [V] | −600 | −660 | −600 |

Experi.: Experiment

Figure 5:
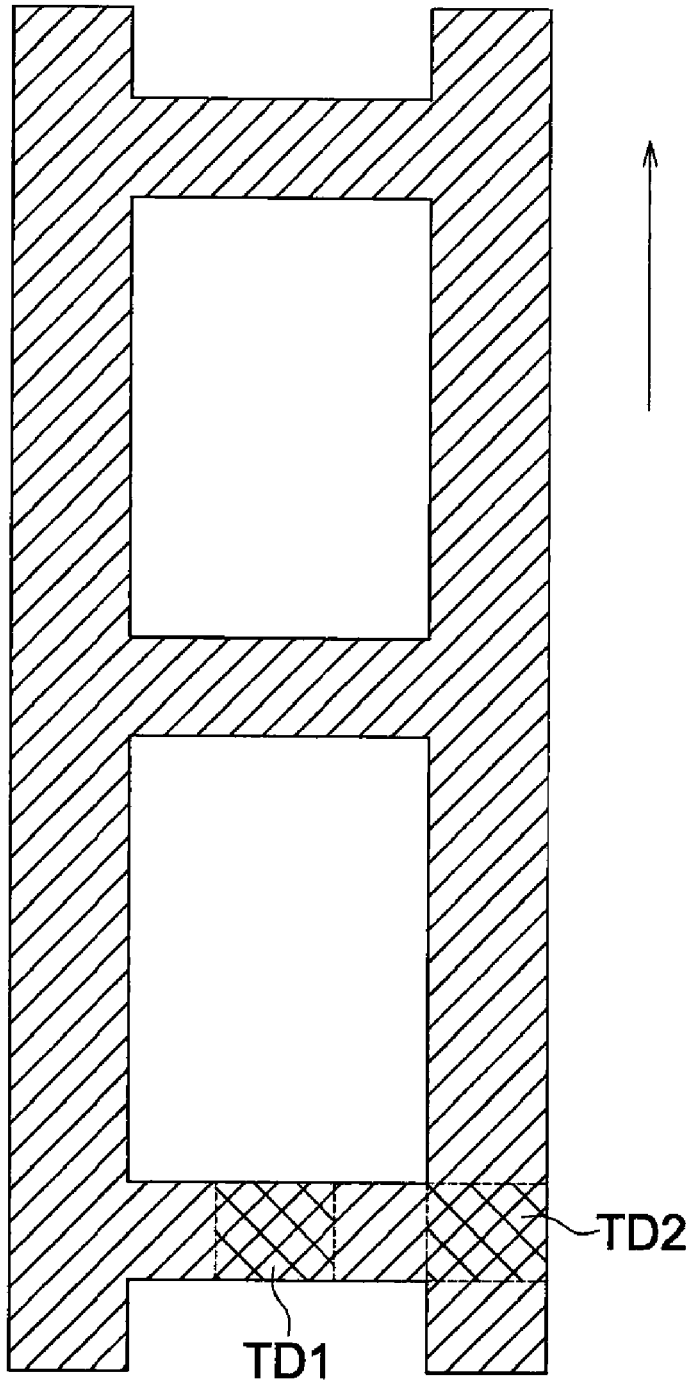
FIG. 5 shows an explanatory schematic diagram indicating an evaluation test pattern.

Further, changing an angle Z of the developing roller 41 in the flat region T (value of angle of the flat region T shown in FIG. 4), in regard to the 10 concerned angles of 3.0°, 4.5°, 6.5°, 7.0°, 10.0°, 11.5°, 13.0°, 14.0°, 15.0° and 17.0°. In this connection, the changes of the angle Z were achieved by changing the shape and/or the material of the peeling magnetic pole N2. Still further, the evaluations of the density deterioration of the image were implemented by forming an evaluation pattern shown in FIG. 5 onto the image bearing member 1 (the solid line arrow shown in FIG. 5 indicates the rotational direction of image bearing member 1, while the hatched area indicates the toner adhered area), based on a value (ghost value) derived by subtracting the density value of an area TD2 from that of an area TD1 in the evaluation pattern. Density values were those detected by the toner density sensor 406. As shown in FIG. 5, none of toner adheres to an area located in the upstream side of the rotational direction of the image bearing member 1 relative to the area TD1, while toner adheres to another area located in the upstream side of the rotational direction of the image bearing member 1 relative to the area TD2.

Figure 6:
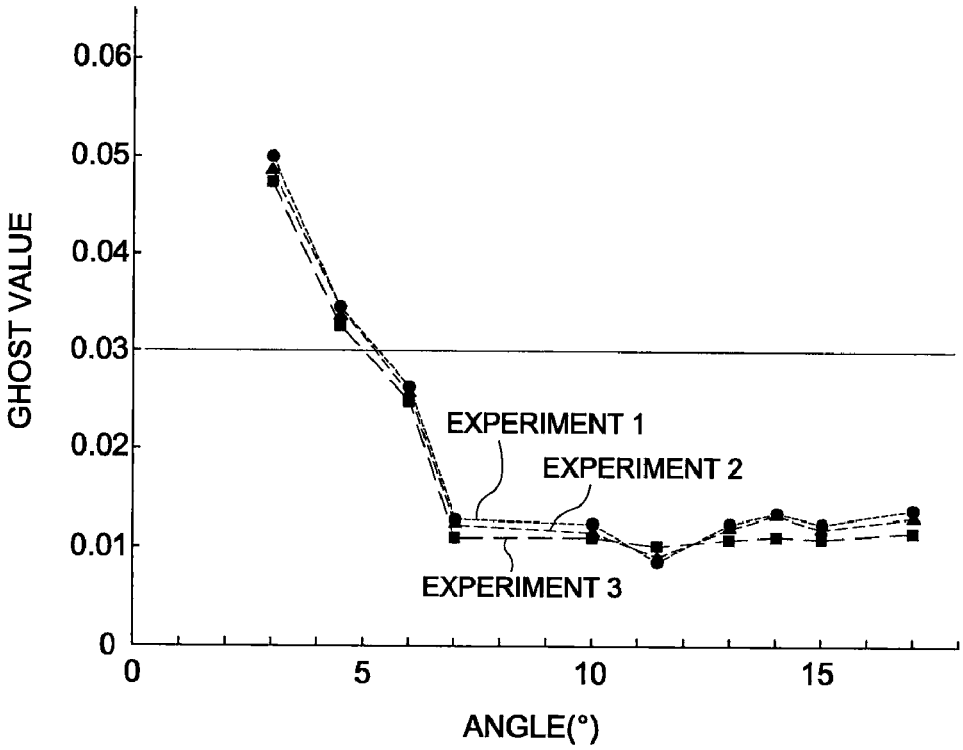
FIG. 6 shows a graph indicating evaluation results of density deterioration of an image.

FIG. 6 shows a graph indicating the evaluation results of the density deterioration of the image. In FIG. 6, the horizontal axis represents the angle Z of the developing roller 41 corresponding to the flat region T, while the vertical axis represents the ghost value. Although the present inventor has recognized that the area in which the ghost value is equal to or smaller than 0.03 exhibits good releasability of the developer and causes no density deterioration of the image, the present inventor has also found that the area in which the angle Z is equal to or greater than 7° exhibits specifically good results in the experiments 1 through the experiments 3, irrespective of the outer diameter of the developing roller 41, and irrespective of the electric field conditions.

As described in the foregoing referring to the FIG. 3 through FIG. 6, the flat region T, in which the magnetic flux density is kept substantially the same as the maximum value X, is made to exist within a certain predetermined region, so as to weaken the centripetal force Fr to be generated by the peeling magnetic pole N2. Further, by making the magnetic flux density abruptly reduce in a suitable region towards the developer-layer forming magnetic pole N3 from the peeling magnetic pole N2, a specific region, in which the magnetic flux density is low, is created between the peeling magnetic pole N2 and the developer-layer forming magnetic pole N3. According to the abovementioned, the magnetic field generated by the peeling magnetic pole N2 does not overlap with that generated by the developer-layer forming magnetic pole N3, and as a result, it becomes possible to appropriately peel the developer off the developing roller 41, even if the developing roller 41 is a small-sized developing roller.

Incidentally, although, referring to the drawings, the preferred embodiment has been described in the foregoing, the scope of the present invention is not limited to the above-described embodiment. Modifications and additions made by a skilled person without departing from the spirit and scope of the invention shall be included in the scope of the present invention.

According to a developing device, an image forming apparatus and a developing roller, embodied in the present invention, it becomes possible to appropriately peel developer off the developing roller, even if the developing roller is a small-sized developing roller.

While the preferred embodiments of the present invention have been described using specific term, such description is for illustrative purpose only, and it is to be understood that changes and variations may be made without departing from the spirit and scope of the appended claims.

What is claimed is:

1. A developing device, comprising:

a developing roller to bear developer, including magnetic carriers and toner, on a circumferential surface thereof, so as to develop a latent image formed on an image bearing member; and a developer supplying section to supply the developer onto the developing roller;

wherein the developing roller is provided with:

a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7^\circ$$

where numeral Z indicates an angle of the developing roller in the magnetic-flux density flat region.

2. The developing device of claim 1, wherein the magnetic flux density within the magnetic-flux density flat region is equal to or greater than 98% of the maximum value.

3. An image forming apparatus, comprising:

an image bearing member to form a latent image on a circumferential surface thereof;

a developing device that includes a developing roller to bear developer, including magnetic carriers and toner, on a circumferential surface thereof, so as to develop the latent image formed on the image bearing member;

a transferring section to transfer a toner image formed on the image bearing member; and a fixing section to fix the toner image onto a sheet;

wherein the developing roller is provided with:

a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7^\circ$$

where numeral Z indicates an angle of the developing roller in the magnetic-flux density flat region.

4. The image forming apparatus of claim 3, wherein the magnetic flux density within the magnetic-flux density flat region is equal to or greater than 98% of the maximum value.

5. A developing roller that bears developer, including magnetic carriers and toner, on a circumferential surface thereof, so as to develop a latent image formed on an image bearing member, comprising:

a developing sleeve that is made of a non-magnetic material; and a magnetic member that is installed into an inner space of the developing sleeve and provided with a plurality of fixed magnetic poles including at least a peeling magnetic pole; and wherein, when a reference position is defined as such a position that exhibits a maximum value of a magnetic flux density to be generated in a normal direction by the peeling magnetic pole, a magnetic-flux density flat region within which the magnetic flux density is kept at substantially a constant value being closely approximate to the maximum value of the magnetic flux density and the reference position is included, exists while fulfilling an Equation indicated as follow:

$$Z \geqq 7^\circ$$

where numeral Z indicates an angle of the developing roller in the magnetic-flux density flat region.

6. The developing roller of claim 5, wherein the magnetic flux density within the magnetic-flux density flat region is equal to or greater than 98% of the maximum value.

* * * * *